US006626709B2

(12) United States Patent
Cisey

(10) Patent No.: US 6,626,709 B2
(45) Date of Patent: Sep. 30, 2003

(54) FASTENING SYSTEM AND ELEMENTS USING THIS SYSTEM

(75) Inventor: Johann Cisey, Saint Symphorien d'Ancelles (FR)

(73) Assignee: Entrelec S.A., Lyons (FR)

( * ) Notice: Subject to any disclaimer, the term of this patent is extended or adjusted under 35 U.S.C. 154(b) by 0 days.

(21) Appl. No.: 10/137,371

(22) Filed: May 3, 2002

(65) Prior Publication Data

US 2002/0173203 A1 Nov. 21, 2002

(30) Foreign Application Priority Data

May 15, 2001 (FR) ..... 01 06407

(51) Int. Cl.[7] ..... H01R 9/22; H01R 13/502
(52) U.S. Cl. ..... 439/717; 439/701
(58) Field of Search ..... 439/717, 701, 439/712, 715, 594, 724

(56) References Cited

U.S. PATENT DOCUMENTS

| | | | | |
|---|---|---|---|---|
| 3,701,087 A | * | 10/1972 | Bernard | 439/724 |
| 3,771,104 A | * | 11/1973 | Clark | 439/415 |
| 4,425,018 A | | 1/1984 | Stenz | 439/701 |
| 4,637,496 A | * | 1/1987 | Atkey et al. | 187/408 |
| 5,212,347 A | * | 5/1993 | Powers et al. | 174/67 |
| 6,077,127 A | * | 6/2000 | Wu | 439/717 |
| 6,113,415 A | * | 9/2000 | Bertsch et al. | 439/353 |
| 6,393,882 B1 | * | 5/2002 | Higgins | 70/370 |

FOREIGN PATENT DOCUMENTS

| | | |
|---|---|---|
| DE | G 94 19 336.3 | 3/1995 |
| FR | 2 481 007 A1 | 10/1981 |
| FR | 2 742 004 A1 | 6/1997 |
| WO | 100 05 219 A 1 | 9/2000 |

* cited by examiner

*Primary Examiner*—Chandrika Prasad
(74) *Attorney, Agent, or Firm*—Oliff & Berridge, PLC

(57) ABSTRACT

This fastening system comprises:

male fastening means which comprise, projecting from a fastening face:

at least one tenon of longitudinal axis X-X' and provided with a free end called the engagement end, a locking rib located at a distance from the tenon, away from the engagement end and oriented transversely to the axis X-X', female fastening means, complementary to the male fastening means, which comprise in a fastening face:

at least one mortise intended to accommodate the tenon, a cavity called an engagement cavity in which the mortise opens out at an engagement face and which has dimensions large enough to allow the tenon to be inserted into the mortise, a locking end stop intended to cooperate with the locking rib when the tenon is completely engaged in the mortise in order to provide an obstacle to relative sliding between the tenon and the mortise.

11 Claims, 4 Drawing Sheets

FASTENING SYSTEM AND ELEMENTS USING THIS SYSTEM

BACKGROUND OF THE INVENTION

The invention relates to the technical field of devices, which may or may not be modular, used to connect and interconnect electrical cables for the distribution of power or of data, or even both. The invention also relates to the field of devices used to provide the same functions within the context of using optical fibers.

Description of the Prior Art

In the above fields, it is known to use modular assemblies such as junction blocks, terminal blocks, connectors or the like. Generally, these devices belong to the same range of elements providing elementary functions and components which can be arranged with each other in various configurations depending on the needs of the final user.

There is therefore a need to have means available to assemble various constituent elements of the product range together, offering considerable simplicity of use combined with high reliability, and even strength, in the completed assemblies.

Utility model DE-94 19 336 has thus proposed a system for fastening a handle and a multipoint male connector together. According to this document, the handle has a series of serrations intended to snap-fasten into complementary housings of the connector. Such a fastening system effectively enables the handle and the connector to be assembled quickly but however has the drawback of not possessing great stiffness and of not being dismantleable.

There therefore appears to be a need to have a new fastening system available which, on the one hand, allows fast assembly and on the other hand, offers guarantees of reliability needed with regard to the actual operation of the plant produced by means of the aforementioned devices and, moreover, allows easy dismantling, if necessary, of the assembly produced by means of the fastening system.

SUMMARY OF THE INVENTION

In order to comply with these objectives, the aim of the invention is a system for fastening together two constituent elements of an electrical connection assembly of the tenon and mortise type, which comprises:

- male fastener which includes:
  - at least one tenon having a longitudinal axis and provided with a free end called an engagement end, and
  - a locking rib located at a distance from the tenon, away from the engagement end and oriented transversely to the longitudinal axis, that projects from a fastening face;
- female fastener, complementary to the male fastener, having in a fastening face:
  - at least one mortise intended to accommodate the tenon,
  - an engagement cavity in which the mortise opens out at an engagement face and which has dimensions large enough to allow the tenon to be inserted into the mortise, and
  - a locking end stop intended to cooperate with the locking rib when the tenon is completely engaged in the mortise in order to provide an obstacle to relative sliding between the tenon and the mortise.

The use of a tenon and mortise fastening means associated with locking means makes it possible, in a very advantageous manner, to obtain an assembly which is easy to produce without tooling and offers good guarantees of mechanical integrity.

Furthermore, the locking provided by the rib on which the locking end stop bears enables easy dismantling of the fastening system without using special tooling.

According to the invention, the male fastening means may comprise one, two or even more tenons placed in parallel, while the female fastening means comprise as many mortises in parallel as the male means have tenons.

Where the male means or the female means have several tenons or mortises, it should be noted that the tenon and mortise assembly is not necessarily produced on or made in a single part but may result from the juxtaposition of several different elements, each one having one or more tenons or mortises.

Thus, all sorts of configurations are possible such as, for example but not exclusively, the case where a component would comprise a plurality of tenons, each of which then being linked with a complementary component comprising a single mortise.

According to another characteristic of the invention, in order to reinforce the reliability of the locking, the male fastening means comprise a rib called a support rib, which lies transversely to the axis X-X' at a distance from the fastening rib and which defines a support, for the engagement face, of the mortise when the tenon is completely engaged in the mortise.

According to yet another characteristic of the invention, in order to reinforce the buckling resistance of the tenons and of the fastening face bearing the latter, each tenon preferably has a T-shaped cross section. Of course, the mortises and the female fastening means then have a complementary shape.

According to another characteristic of the invention, in order to facilitate the dismantling of the fastening system, the engagement cavity is open laterally so as to allow a tool to be inserted between the fastening faces constituting the male and female fastening means, in the fastened position. Thus, the lateral opening of the engagement cavity offers the possibility of introducing the blade of a screwdriver which makes it possible to exert a force in the direction of a relative separation in order to free the locking end stop from its engagement with the locking rib.

The aim of the invention is also various types of connection components using the male and/or female fastening means of the fastening system according to the invention.

BRIEF DESCRIPTION OF THE DRAWINGS

Various other characteristics of the invention will emerge from the description below given with reference to the drawings which illustrate various nonlimiting embodiments and implementations of the fastening system according to the invention.

DESCRIPTION OF THE PREFERRED EMBODIMENTS

Figure 1:
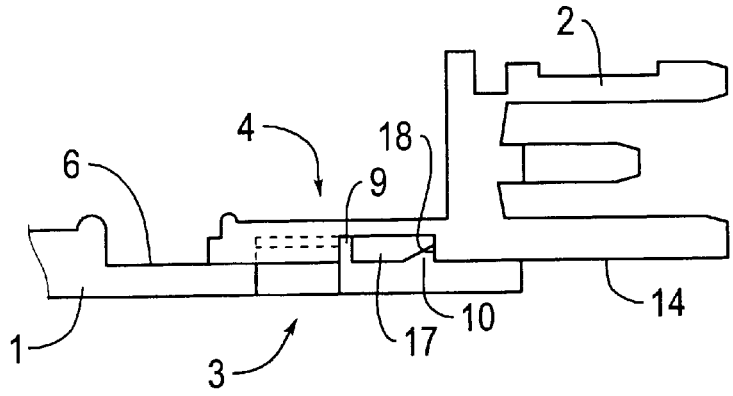
FIG. 1 is an elevation in the assembled position of two elements using a fastening system according to the invention.

A fastening system according to the invention may be used to assemble various elements. Thus, FIG. 1 illustrates, by way of nonlimiting example, one use of the fastening system for assembling a manipulation handle 1 and a male connector 2 of the type, for example, marketed by Entrelec.

Figure 2:
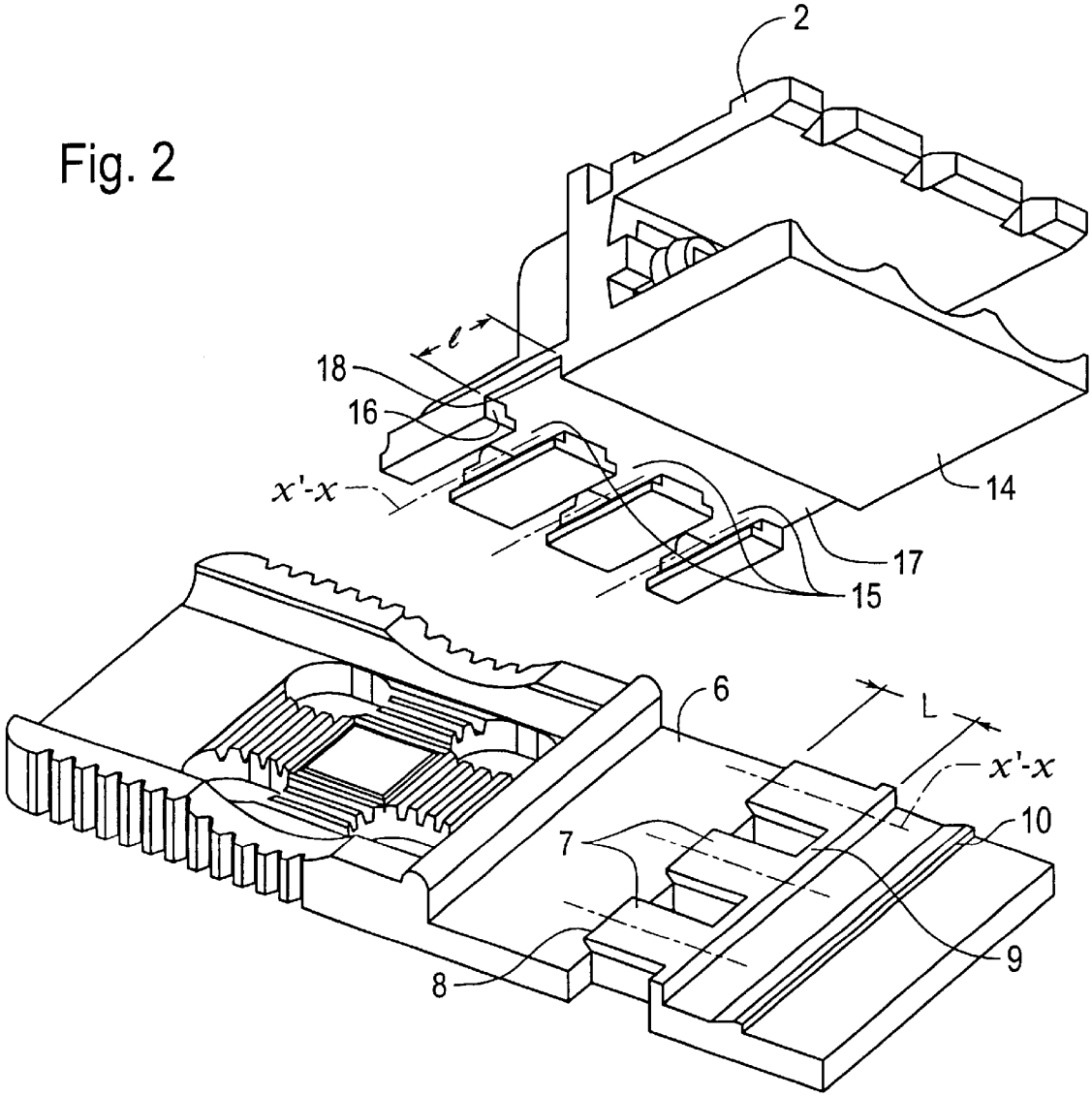
FIGS. 2 and 3 are perspective views of the elements of FIG. 1 in the dismantled position showing a particular embodiment of the female fastening means constituting the fastening system according to the invention.
Figure 3:
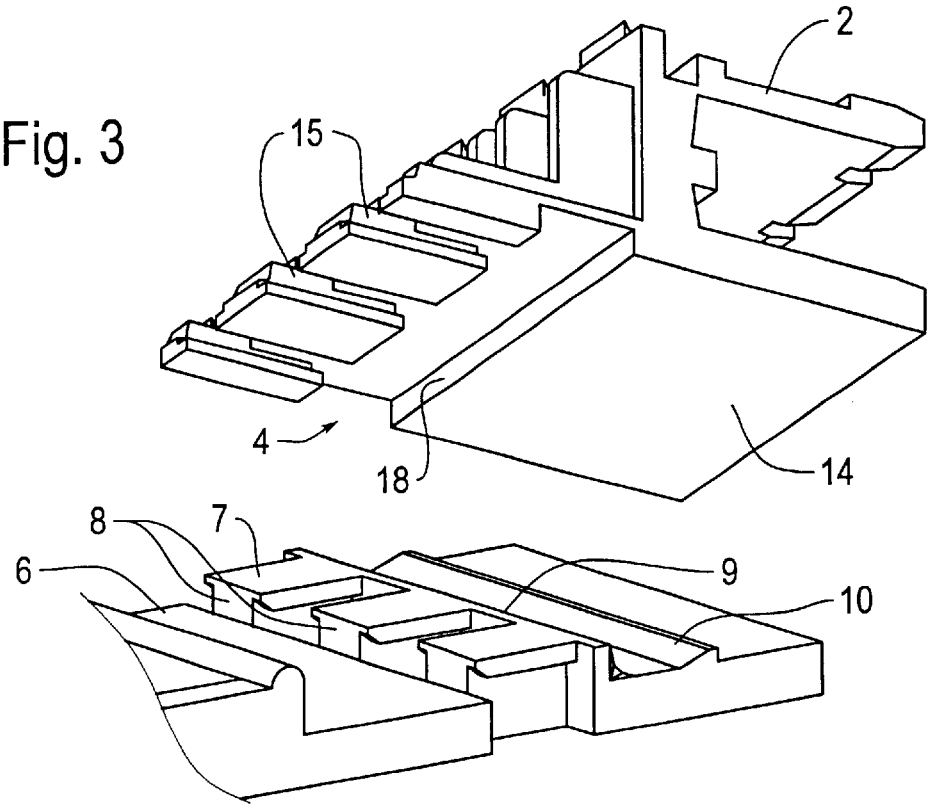

The fastening system according to the invention comprises male fastening means 3, as more particularly illustrated in FIGS. 2 and 3, formed on the handle 1. The fastening system also comprises female fastening means 4 made in the connector 2, as is also illustrated in FIGS. 2 and 3.

As emerges from FIGS. 2 and 3, the male fastening means 3 comprise, projecting from a fastening face 6, three mutually parallel tenons 7 with a longitudinal axis X-X'. In order to provide good buckling resistance, the tenons 7 have a T-shaped cross section. Of course, any other shape could be envisaged such as, for example, a dovetail shape. Each tenon 7 has a free end 8 called an engagement end, the function of which will emerge below.

Away from the engagement end 8, the tenons back onto a rib 9 called a support rib, extending transversely to the axes X-X' of the tenons 7. Furthermore, the male fastening means 3 comprise a rib 10 called a locking rib extending at a distance from the tenons 7 and away from the engagement ends 8. Thus, the locking rib 10 is at a distance from the support rib 9, while being parallel thereto, and therefore transverse to the axes X-X' of the tenons 7.

To allow the handle 1 to be attached to the connector 2, the female fastening means 4 have a shape complementary to that of the male fastening means. Thus, the female fastening means 4 comprise, in a fastening face 14, three mutually parallel mortises 15 with an axis X-X'.

Of course, each mortise 15 has a shape complementary to that of the tenon intended to be engaged therein. Thus, the mortises have a T-shaped cross section. The mortises 15 all open out at an engagement face 16 in a cavity 17 also called an engagement cavity, whose function will become apparent below. According to the example illustrated, this cavity 17 has a U-shaped cross section and defines, away from the engagement face 16, a locking end stop 18 intended to cooperate with the locking rib 10, as will emerge below. Moreover, the engagement cavity 17 is open laterally.

The handle 1 and the connector 2 are fastened to the male 3 and female 4 fastening means according to the invention, as follows.

Figure 4:
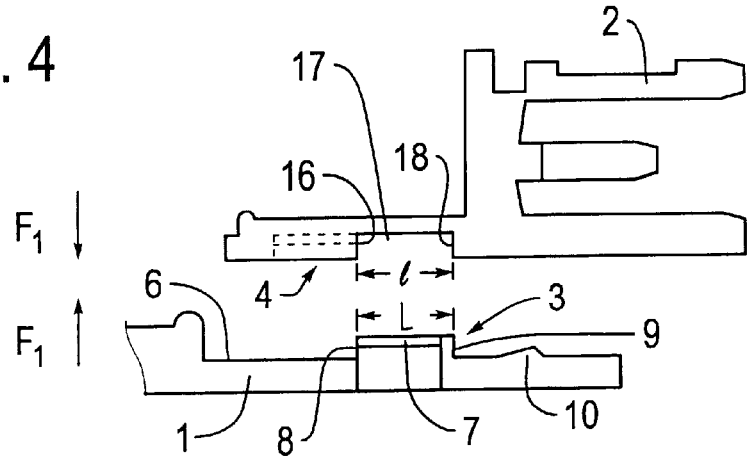
FIGS. 4 and 5 are elevations similar to FIG. 1, showing two phases where the fastening means according to the invention are used in order to provide the assembly as illustrated in FIG. 1.

First of all, the tenons 7 and the engagement cavity 17 are placed facing each other, as shown in FIG. 4. Next, the tenons 7 are engaged in the engagement cavity 17 by a movement in the direction of the arrows F1 of FIG. 4. It should be noted that, in order to allow this engagement, the width l of the cavity 17, that is to say the distance between the engagement face 16 and the end stop 16, is substantially equal to the length L of the tenons 7 including the support rib 9.

Figure 5:
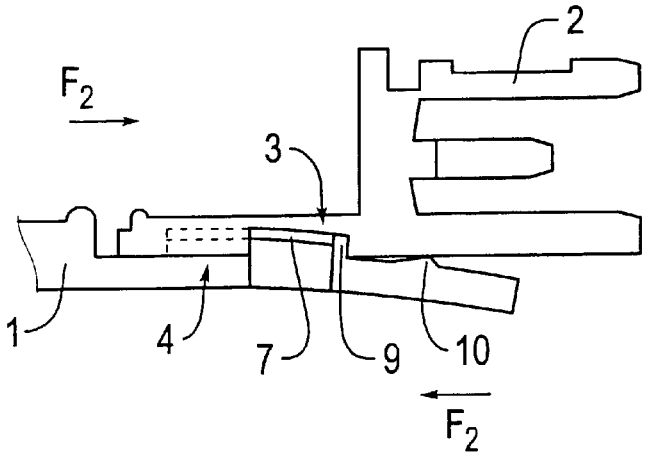

Once the tenons 7 are inserted into the engagement cavity 17, as illustrated in FIG. 5, a translational movement in the direction of the arrows F2 is carried out so as to slide the tenons 7 inside the mortises 15. This sliding is carried out until the engagement face 16 is brought to bear on the support rib 9 while the end stop 18 is placed behind the locking rib 10, as emerges from FIG. 1. The fastening means are then locked, the locking end stop 18 cooperating with the locking rib 10, while the engagement face 16 bears against the support rib 9. Translational movements in a direction opposite to that of the arrows F2 are thus blocked, prohibiting any accidental dismantling of the handle 1 and connector 2 assembly.

However, when dismantling is desired, it is possible to insert, through the open sides of the engagement cavity 17, a tool between the two fastening faces so that the locking end stop 18 is released from pressing against the locking rib 10 so as to allow translation in directions opposite to those of the arrow F2 in order to remove the tenons 7 from the mortises 15.

Thus, the male 3 and female 4 fastening means according to the invention enable fast and strong assembly of the handle 1 onto the connector 2 to be provided while allowing easy dismantling thereof.

Figure 6:
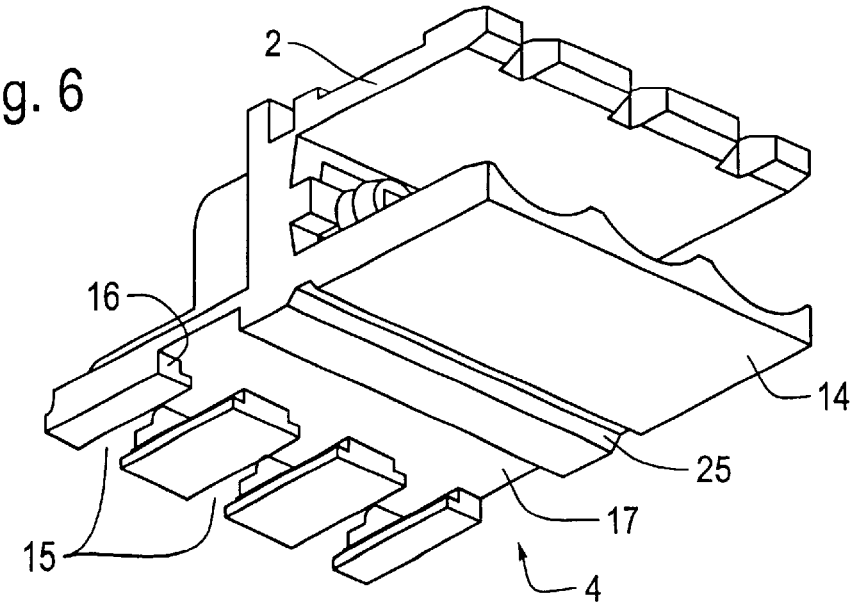
FIG. 6 is a perspective view similar to FIG. 2, showing a variant embodiment of the female fastening means.

It should be noted that, during assembly and dismantling, the elastic deformability of the end of the handle 1, carrying the locking rib 10, is turned to advantage. However, in order to facilitate the assembly operation without having to exert too large a force in the direction of the arrows F1, the female fastening means 4 may comprise, at a distance from the cavity 17, a groove 25 as illustrated in FIG. 6. This groove 25 is then intended to accommodate the locking rib 10 on engaging the tenons 7 in the cavity 17 in a position similar to that shown in FIG. 7.

To further facilitate the assembly, the ends of the wings of the tenons 7, located at the side of the insertion ends 8, are beveled. Similarly, the locking rib 10 defines, by its face oriented toward the tenons 7, an inclined sliding rail.

Figure 8:
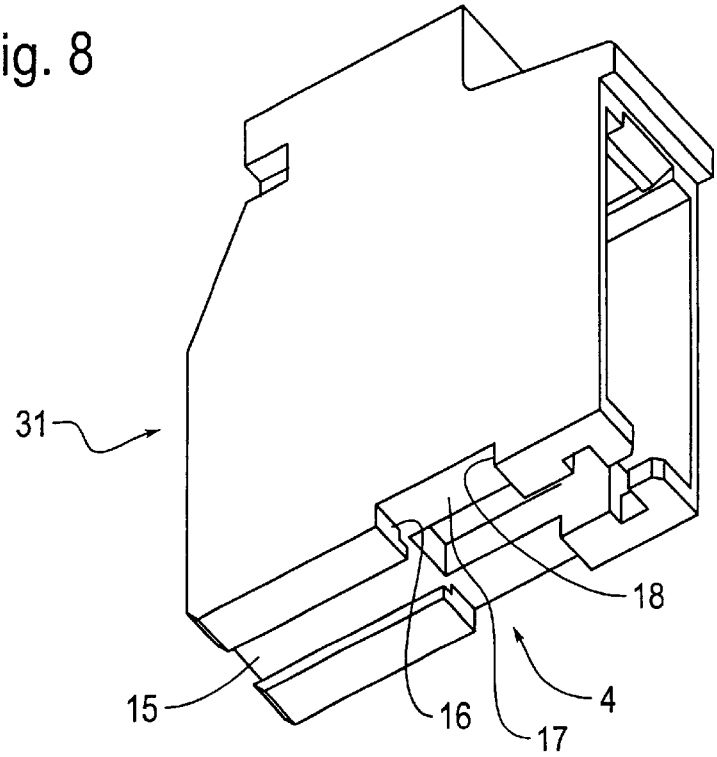
FIGS. 7 and 8 illustrate other types of device using the fastening system according to the invention.
Figure 7:
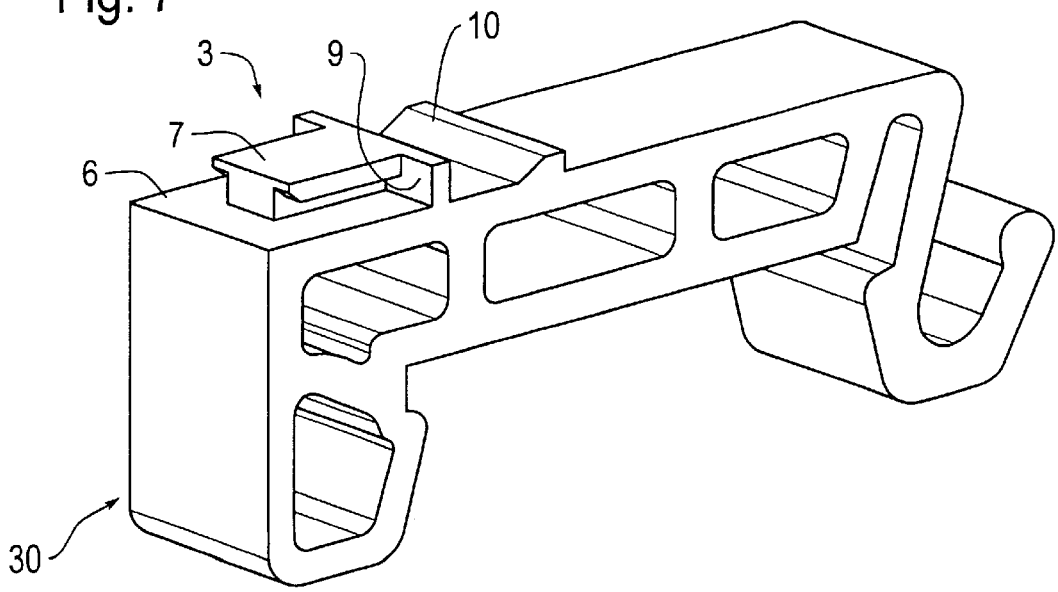

According to the invention, the fastening means may be used for various types of components. Thus FIG. 7 illustrates an exemplary embodiment of the male fastening means 3 on an attachment foot 30 on an Ω-shaped rail. It should be noted, according to this example, that the male fastening means 3 comprise only a single tenon 7. Similarly, FIG. 8 illustrates an exemplary embodiment of female fastening means 4 on a connection casing 31 or junction block of the insulation-displacement system type. As for the example in FIG. 6, it should be noted that the female fastening means 4 have only a single mortise 7.

Of course, the fastening system according to the invention may be used for various other component types than those described above and illustrated in the appended figures.

Moreover, according to the example illustrated, the male fastening means 3 have a support rib 9 backing onto the tenons 7. However, it is possible for the male fastening means 3 not to comprise such a rib which could then be replaced with a bottom wall for the mortises 15 which would then bear on the engagement end 8 of the tenons 7.

The invention is not limited to the examples described above since various modifications could be provided thereto without departing from its scope.

What is claimed is:

1. A system for fastening two constituent elements of an electrical connection assembly of the tenon and mortise type, which comprises:

a male fastener which includes:

at least one tenon having a longitudinal axis and provided with a free end called an engagement end, and a locking rib located at a distance from the tenon, away from the engagement end and oriented transversely to the longitudinal axis, that projects from a fastening face;

a female fastener, complementary to the male fastener, having in a fastening face:

at least one mortise intended to accommodate the tenon, an engagement cavity in which the mortise opens out at an engagement face and which has dimensions large enough to allow the tenon to be inserted into the mortise, and a locking end stop intended to cooperate with the locking rib when the tenon is completely engaged in the mortise in order to provide an obstacle to relative sliding between the tenon and the mortise.

2. The fastening system as claimed in claim 1, wherein:

the male fastener comprises at least two parallel tenons, and the female fastener comprise at least two mortises intended to accommodate the two tenons of the male fasteners.

3. The fastening system as claimed in claim 1, wherein the male fastener comprises a support rib, which lies transversely to the longitudinal axis at a distance from the fastening rib and which defines a support for the engagement face of the mortise when the tenon is completely engaged in the mortise.

4. The fastening system as claimed in claim 1, wherein the tenon has a T-shaped cross section.

5. The fastening system as claimed in claim 1, wherein the engagement cavity is open laterally so as to allow a tool to be inserted between the male and female fasteners, in the fastened position.

6. An electrical connection component, which comprises male and/or female fasteners claimed in claim 1.

7. A foot for attaching at least one electrical connection component to an Ω-shaped rail, wherein it comprises male and/or female fasteners as claimed in claim 1.

8. A handle for manipulating electrical connection components, which comprises male and/or female fasteners as claimed in claim 1.

9. An assembly made up of an electrical connector and of a manipulation handle, which is assembled by fasteners as claimed in claim 1.

10. A connection block, which comprises male and/or female fasteners as claimed in claim 1.

11. An electrical connector, which comprises male and/or female fasteners as claimed in claim 1.

* * * * *